United States Patent [19]

Nguyen

[11] Patent Number: 4,703,814

[45] Date of Patent: Nov. 3, 1987

[54] EARTH BORING BIT HAVING A REPLACEABLE, THREADED NOZZLE WITH WRENCH SOCKET

[75] Inventor: David M. Nguyen, Houston, Tex.

[73] Assignee: Hughes Tool Company - USA, Houston, Tex.

[21] Appl. No.: 46,204

[22] Filed: May 4, 1987

Related U.S. Application Data

[63] Continuation of Ser. No. 819,645, Jan. 16, 1986, abandoned.

[51] Int. Cl.[4] ..... E21B 10/60

[52] U.S. Cl. ..... 175/393; 175/424

[58] Field of Search ..... 175/329, 340, 393, 424; 239/589, 599, 600, 601

[56] References Cited

U.S. PATENT DOCUMENTS

| | | | |
|---|---|---|---|
| 2,125,445 | 8/1938 | Holveck | 239/599 |
| 3,785,560 | 11/1985 | Hruby, Jr. | 239/17 |
| 4,022,286 | 5/1977 | Gill | 175/313 |
| 4,098,363 | 7/1978 | Rohde et al. | 175/329 |
| 4,176,723 | 12/1979 | Arceneaux | 175/329 |
| 4,323,130 | 4/1982 | Dennis | 175/329 |
| 4,372,399 | 2/1983 | Cork | 175/65 |
| 4,396,077 | 8/1983 | Radtke | 175/393 |
| 4,429,755 | 2/1984 | Williamson | 175/329 |
| 4,494,618 | 1/1985 | Radtke | 175/393 |
| 4,527,642 | 7/1985 | Knowlton et al. | 175/329 |
| 4,603,750 | 5/1986 | Sorenson | 175/393 |

*Primary Examiner*—Stephen J. Novosad
*Attorney, Agent, or Firm*—Robert A. Felsman

[57] ABSTRACT

An improved earth boring bit of the type having diamond cutting elements and a fluid passageway to direct drilling fluid toward a borehole bottom during drilling, a metal nozzle with a cylindrical, threaded exterior and a noncircular throat having a minimum cross sectional dimension to receive a mating wrench and a length to resist damage from the torque required to make-up and break-out the nozzle for threads in the body of the bit.

9 Claims, 3 Drawing Figures

EARTH BORING BIT HAVING A REPLACEABLE, THREADED NOZZLE WITH WRENCH SOCKET

This application is a continuation of application Ser. No. 819,645, filed 01/16/86, now abandoned.

BACKGROUND OF THE INVENTION

1. Field of the Invention:

This invention relates in general to earth boring bits, especially to those with replaceable fluid nozzles.

2. Background Information:

Earth boring bits used for drilling deep wells for petroleum and minerals have wear resistant nozzles to direct fluid against the bottom of the borehole. Usually, the nozzles are replaceable to accommodate the "hydraulic program" for each particular drilling rig and expected depth interval.

Nozzle designs include those retained with snap rings, nails and threads in a variety of configurations. Nozzles retained with threads sometimes have a hexagonal socket on the lower end to receive an "Allen" type wrench for insertion and removal of the nozzle. Some nozzles have noncircular throats to accomplish such purposes as diffusion of the exit stream and an irregular flow passage in an attempt to prevent blockage by solids in the drilling fluid. And yet, there is need for an improved compact nozzle configuration or design in all types of bits, including the "diamond" bit where the placement of natural or artificial diamonds and the fluid nozzles may be especially restricted due to severe space limitations.

SUMMARY OF THE INVENTION

It is the general object of the invention to provide an earth boring bit, especially the diamond type, with a replaceable nozzle of wear resistant material that is threaded on its exterior and a noncircular throat with a minimum cross sectional dimension to receive a mating wrench for insertion or removal of the nozzle. The nozzle throat has a length to transmit makeup and break-out torque without damage to the metal of the throat. The upstream portion of the nozzle is convergent toward the noncircular entrance of the throat, which is preferably hexagonal, to minimize hydraulic losses.

The above as well as additional objects, features, and advantages of the invention will become apparent in the following detailed description.

DESCRIPTION OF THE PREFERRED EMBODIMENT

Figure 1:
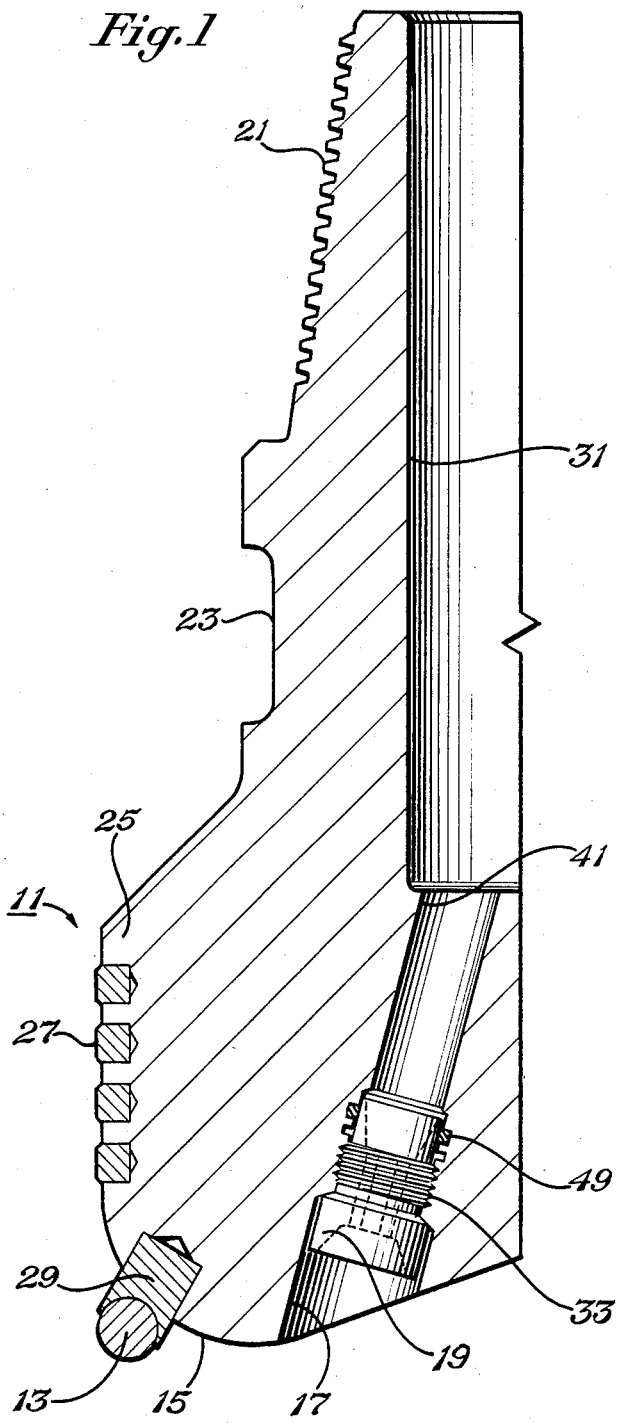
FIG. 1 is a longitudinal section of one half an earth boring bit of the type using polycrystalline diamonds for cutting elements, with nozzle sockets into which replaceable nozzle are to be inserted before use in drilling.

The numeral 11 in the drawing designates an earth boring bit of the type which utilizes earth disintegrating cutters 13 of polycrystalline diamond dispersed selectively in face 15. Fluid passages 17 extend through the face and provide support for wear resistant fluid nozzles 19, preferably of sintered tungsten carbide.

Figure 2:
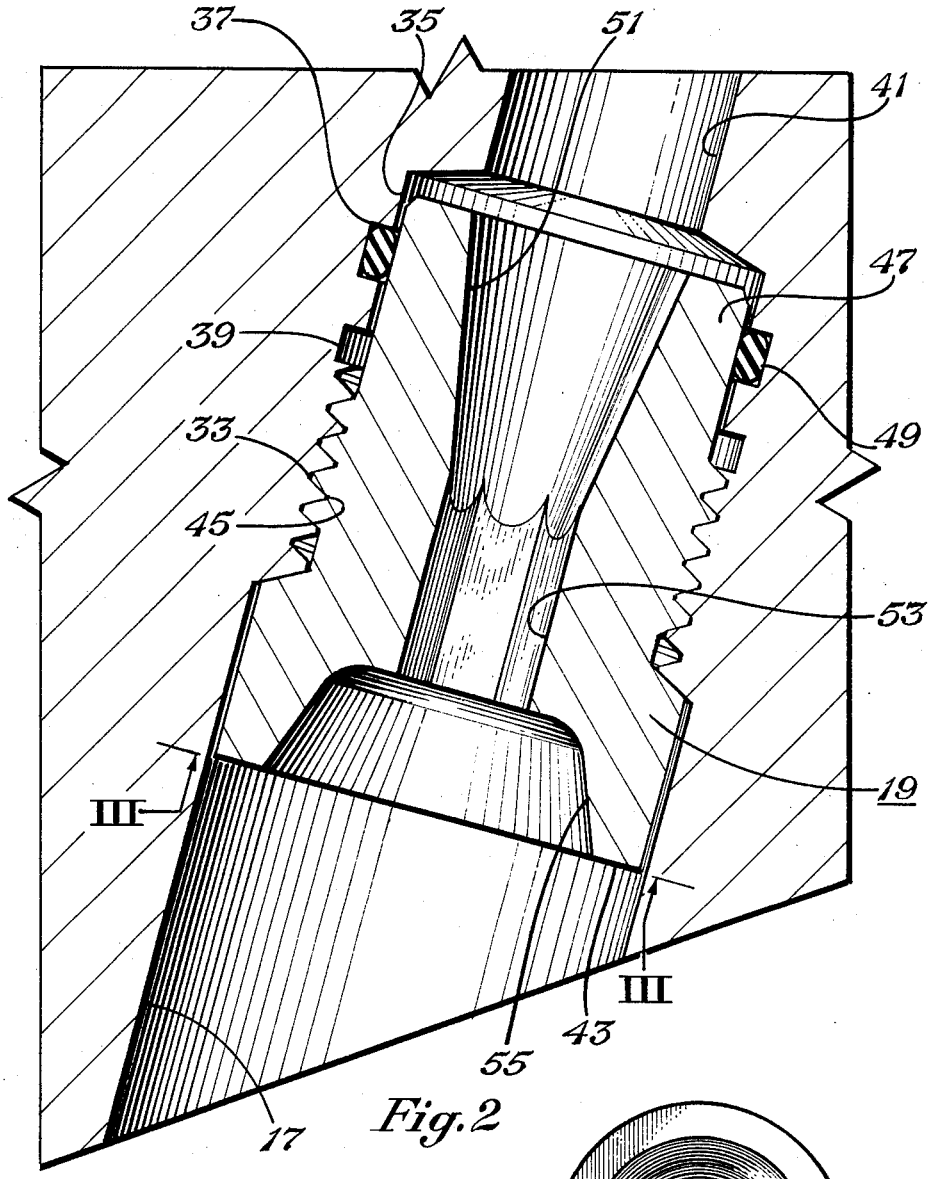
FIG. 2 is fragmentary longitudinal section, enlarged as compared to FIG. 1, to show greater detail of a replaceable nozzle and related components used for assembly with the body of the bit.

In FIG. 1 only one half of a longitudinal section of the bit is shown, sufficient to indicate that the body of the bit has a threaded upper end 21 above a wrench flat 23, flaring into a drill head 25. Gate compacts 27 extend radially from the drill head into contact with the wall of the hole (not shown) during drilling, being secured by interference fit. Similarly, each polycrystalline diamond cutter 13 (only one of which is shown in FIG. 1) is secured on a sintered tungsten carbide substrate 29, preferably cylindrical in cross section and secured by interference fit in a mating drilled hole in the drill head 25. Thus, the FIG. 1 embodiment is one commonly called a "steel head" bit, but the invention is applied with equally successful results to other types of bits such as the "matrix" bit. Inside the body of the bit is a cavity 31 to receive a "drilling fluid" from the drill string (not shown) to which the threaded upper end 21 of the bit is connected. The drilling fluid passage 17 contains the nozzle 19—as better seen with reference to FIG. 2.

The passage 17 is formed of a lower counterbore, an intermediate, threaded counterbore 33 and an upper counterbore 35 having an o-ring groove 37 and a thread runout 39. The body 41 of the passage communicates with the cavity 31 as best seen in FIG. 1.

Figure 3:
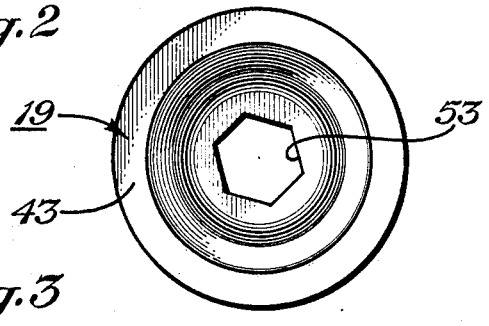
FIG. 3 is a cross sectional view as seen looking along the lines III—III of FIG. 2.

The nozzle 19 has a flange 43 that registers with the upper counterbore of the passage 17, integral threads 45 to mate with the threads 33 of the intermediate counterbore, and an upper cylindrical end 47 that engages and seals against an o-ring 49. Thus, all fluid that flows through the passage 17 must pass through the bore of the nozzle 19, first through a convergent upper end 51 and then through a noncircular throat 53 (which is hexagonal, as best seen in FIG. 3) and through a divergent lower end 55.

The purpose of the hexagonal throat is to provide a means to apply torque to the nozzle 19 in a manner that minimizes size while providing excellent strength. This enables the use of an Allen type wrench to be inserted into the throat 53 of the nozzle to provide make-up and break-out torque. The throat has a minimum cross sectional dimension to receive the mating wrench and a minimum length to transmit the torque of make-up and break-out without damage to the nozzle. In the embodiment shown here the minimum cross sectional dimension (meaning the distance across an opposed pair of parallel flats of the hexagon shaped throat 53) should be not less than 3/16 inch and the length of the throat should be not less than ¼ inch.

The advantages of the invention are apparent from an operational description. Before a bit 11 containing the invention is lowered on a drill string prior to drilling, the nozzles 19 are selected in view of the pumping equipment of the drilling rig and the depth interval expected for the bit. This determines the size of the throat 53 for each nozzle—all above the minimum dimension referred to previously. Then, the nozzles are inserted with the assistance of an Allen wrench of a size to mate with the selected dimension of the throat 53. Make-up torque is applied through the length of the throat, and hence any possible damage to the nozzle is minimized.

When the bottom of the hole is reached and the pumps of the rig activated, fluid flows into the cavity 31 and through each of the passages 17 and the nozzles 19.

The convergent upper end 51 of the nozzle serves as an entrance passage in the nozzle leading to and connected with the throat to minimize turbulence as the fluid flows from the body 41 of the passage to achieve better efficiencies. The divergent lower end 55 provides good flow characteristics for the stream of fluid exiting from the throat. The use of the throat 53 as a wrench opening and a flow passage permits a minimum cross sectional dimension for the body of the nozzle, enabling bit designers greater flexibility in the placement of nozzles and cutters. Also, an effective and reliable means is provided for the convenient insertion and removal of nozzles—even after the bit has been returned to the rig after drilling and the contaminants and detritus of drilling accumulated around the nozzles.

While the invention has been described in only one of its forms, it should be apparent to those skilled in the art that it is not thus limited, but is susceptible to various changes and modifications without departing from the spirit thereof.

I claim:

1. An improved earth boring bit which comprises in combination:

a metal body having a threaded upper end for attachment to a drill string member;

the body having a cavity to receive drilling fluid from the drill string member;

cutting elements by the lower end of the body;

at least one fluid passage connecting the cavity to the lower end of the body to direct fluid against the bottom of a borehole during drilling;

the passage having threads in at least one region;

a metal nozzle of wear resistant material disposed in the passage, including a cylindrical exterior with an integral threaded portion and a flange end adapted to fill a counterbore at the lowermost part of the passage, the threads being integral with the body;

the flange end of the metal nozzle being free of recesses or indentations for installation or removal;

a throat noncircular in cross section formed axially through the nozzle and extending into the flange, the throat having a minimum cross sectional dimension to receive a mating wrench for selective rotation during insertion or removal of the nozzle and a length to transmit make-up or break-out torque without damage to the metal of the throat;

a convergent entrance passage in the nozzle leading to and connected with the throat;

the flange having a generally cylindrical exterior and an interior that diverges outwardly from the throat to the extremity of the nozzle.

2. The invention defined by claim 1 wherein the minimum cross sectional dimension of the throat is not less than 3/16 inch and the length of the throat is not less than ¼ inch.

3. The invention defined by claim 2 wherein the throat is hexagonal in cross section and the nozzle is of sintered tungsten carbide.

4. An improved earth boring bit which comprises in combination:

a metal body having a threaded upper end for attachment to a drill string member;

the body having a cavity to receive drilling fluid from the drill string member;

diamond cutting elements dispersed across the bottom of the body;

a fluid passage connecting the cavity to the water course to direct fluid against the bottom of a borehole during drilling;

the passage having threads in at least one region;

a metal nozzle of wear resistant material disposed in the passage, including a cylindrical exterior with an integral threaded portion and a flange end adapted to fill a counterbore at the lowermost part of the passage, the threads being integral with the body;

the flange end of the metal nozzle being free of recesses or indentations for installation or removal;

a throat noncircular in cross section formed axially through the nozzle and extending into the flange, the throat having a minimum cross sectional dimension to receive a mating wrench for selective rotation during insertion or removal of the nozzle and a length to transmit make-up or break-out torque without damage to the metal of the throat;

a convergent entrance passage in the nozzle leading to and connected with the throat;

the flange having a generally cylindrical exterior and an interior that diverges outwardly from the throat to the extremity of the nozzle.

5. The invention defined by claim 4 wherein the minimum cross sectional dimension of the throat is not less than 3/16 inch and the length of the throat is not less than ¼ inch.

6. The invention defined by claim 5 wherein the throat is hexagonal in cross section and the nozzle is of sintered tungsten carbide.

7. An improved earth boring bit which comprises in combination:

a metal body having a threaded upper end for attachment to a drill string member;

the body having a cavity to receive drilling fluid from the drill string member;

diamond cutting elements dispersed across the lower end of the body;

the lower end of the body having plural lands and plural water courses;

a fluid passage connecting the cavity with a respective water course to direct fluid against the bottom of a borehole during drilling;

each passage having threads in at least one region;

a metal nozzle of wear resistant material disposed in each passage, including a cylindrical exterior with an integral threaded portion and a flange end adapted to fill a counterbore at the lowermost part of the passage, the threads being integral with the body;

the flange end of the metal nozzle being free of recesses or indentations for installation or removal;

a throat noncircular in cross section formed axially through the nozzle and extending into the flange, the throat having a minimum cross sectional dimension to receive a mating wrench for selective rotation during insertion or removal of the nozzle and a length to transmit make-up or break-out torque without damage to the metal of the throat;

a convergent entrance passage in the nozzle leading to and connected with the throat;

the flange having a generally cylindrical exterior and an interior that diverges outwardly from the throat to the extremity of the nozzle.

8. The invention defined by claim 7 wherein the minimum cross sectional dimension of the throat is not less than 3/16 inch and the length of the throat is not less than ¼ inch.

9. The invention defined by claim 8 wherein the throat is hexagonal in cross section and the nozzle is of sintered tungsten carbide.

* * * * *